US010743692B1

(12) United States Patent
Mackey

(10) Patent No.: US 10,743,692 B1
(45) Date of Patent: Aug. 18, 2020

(54) APPARATUS FOR RECEIVING AND PROTECTING A MAIL

(71) Applicant: Charles Mackey, Cincinnati, OH (US)

(72) Inventor: Charles Mackey, Cincinnati, OH (US)

( * ) Notice: Subject to any disclaimer, the term of this patent is extended or adjusted under 35 U.S.C. 154(b) by 0 days.

(21) Appl. No.: 16/210,193

(22) Filed: Dec. 5, 2018

(51) Int. Cl.
*A47G 29/12* (2006.01)

(52) U.S. Cl.
CPC ..... *A47G 29/1216* (2013.01); *A47G 29/1203* (2013.01)

(58) Field of Classification Search
CPC ..... A47G 29/1216; A47G 29/1203; A47G 29/14; A47G 29/16; A47G 29/20; A47G 29/124; A47G 2029/144; A47G 2029/148; B65D 33/14
USPC ..... 232/17, 19, 1 C, 1 E, 39, 45; 211/86.01
See application file for complete search history.

(56) References Cited

U.S. PATENT DOCUMENTS 4,703,850 A * 11/1987 Walker ..... A45C 3/12 206/288
4,909,052 A * 3/1990 Hutwohl ..... A47G 29/20 109/50
5,027,948 A * 7/1991 Forbes ..... G11B 23/023 206/387.11
5,624,071 A * 4/1997 Sosan ..... A47G 29/20 232/1 B
5,845,843 A * 12/1998 Kuller ..... A47G 29/12 232/38
5,931,316 A * 8/1999 Carpinelli ..... A47F 7/14 108/26
6,155,715 A * 12/2000 Lake ..... A47G 29/20 150/102
6,736,310 B1 5/2004 Mesol
D644,814 S * 9/2011 Clarke ..... D99/33
8,042,729 B2 10/2011 Dinh
9,307,814 B2 * 4/2016 Pulliam ..... A45C 3/06
9,364,112 B2 * 6/2016 Sundaresan ..... A47G 29/124
9,596,952 B2 * 3/2017 Mencel ..... A47G 29/20
9,926,108 B2 * 3/2018 Wiley ..... B65D 33/00
10,083,561 B2 * 9/2018 Sundaresan ..... E05B 73/0011
10,143,320 B1 * 12/2018 Batts ..... A47G 29/20
10,143,321 B2 * 12/2018 Hippert ..... A47G 29/20
10,321,780 B1 * 6/2019 James ..... A47G 29/16
2013/0061499 A1 * 3/2013 Berglund ..... G09F 1/00 40/607.1
2016/0051073 A1 * 2/2016 Heinz ..... A47G 29/141 232/39
2017/0127868 A1 * 5/2017 Adewuyi ..... A47G 29/141
2018/0296016 A1 * 10/2018 Teoh ..... A47G 29/20

* cited by examiner

*Primary Examiner* — William L Miller
(74) *Attorney, Agent, or Firm* — Sanchelima & Associates, P.A.; Christian Sanchelima; Jesus Sanchelima

(57) ABSTRACT

An apparatus for receiving and protecting a mail is disclosed. The apparatus comprises a receptacle having a bottom and sidewalls. The bottom and sidewalls define an interior for the receptacle. At one of the sidewalls, a cover is provided, which is operated to form a closed structure with the receptacle. The apparatus comprises a clamp provided at one of the sidewalls to removably couple the receptacle to a structure. At the interior of the receptacle, a mail is received and the cover is closed to protect the mail.

6 Claims, 4 Drawing Sheets

APPARATUS FOR RECEIVING AND PROTECTING A MAIL

BACKGROUND OF THE INVENTION

1. Field of the Invention

The present disclosure relates to a field of mailboxes and newspaper boxes and attachment assemblies for the same. More particularly, the present invention relates to an apparatus for receiving and protecting a mail or a newspaper, which can be removably coupled to any structure without use of tools.

2. Description of the Related Art

It is known that the mailboxes or mail receptacles are widely used for receiving mail distributed by postal workers and taking mail by consumers. Generally, the mailboxes have a housing or receptacle for accommodating the mails. Typically, the mailboxes are coupled to walls of houses, buildings, etc. In some instance, the mailboxes are supported on freestanding posts.

It is known that brackets are used to mount the mailbox to the wall or to the post. For instance, a user may have to affix a bracket to the wall and couple the mailbox to the bracket. Similarly, in order to affix the mailbox on the freestanding post, at first, the user has to erect the post. After erecting the post, the user may affix the bracket to the post. Subsequently, the user may couple the mailbox to the bracket using known mechanisms.

Various examples of a mailbox secured to a post or a wall are disclosed in prior art. An example of the mailbox secured to a post is disclosed in a U.S. Pat. No. 6,736,310. In U.S. Pat. No. 6,736,310B1, a mailbox system comprising a mailbox assembly having a front opening door, the door being shiftable between a closed disposition and an open disposition is disclosed.

Another example is disclosed in a U.S. Pat. No. 6,772,939. In U.S. Pat. No. 6,772,939, a safety mailbox including a housing having a body portion with an opening is disclosed. A door is attached to the body portion for selectively opening or closing the opening in the housing.

Yet another example is disclosed in a U.S. Pat. No. 8,042,729. In U.S. Pat. No. 8,042,729B2, a mailbox tray mountable to a standard mailbox is disclosed. The mailbox tray comprises a bracket arm and a substantially thin generally rectangular slideable tray. The tray has a mail-facing surface disposed substantially parallel to the top surface of the bottom panel of the mailbox.

Although the disclosures of the above type are useful in receiving mails, they have several disadvantages. Most of the post-mounted mailboxes are rigid. Therefore, construction of the post-mounted mailboxes requires considerable time and efforts. Further, the mailboxes of the above type are typically placed outdoors which exposes the mailboxes to extreme weather conditions such as rain, wind and so on. Exposing to weather may damage the mailbox. Further, the mails or stamps attached to the mails may also get damaged.

Other documents describing the closest subject matter provide for a number of more or less complicated features that fail to solve the problem in an efficient and economical way. None of these patents suggest the novel features of the present invention. Specifically, none of the disclosures in the art disclose an apparatus for receiving mails that is easy to mount and operate.

Therefore, there is a need in the art for an apparatus for receiving and protecting a mail that can be removably coupled to various structures.

SUMMARY OF THE INVENTION

It is one of the main objects of the present invention to provide an apparatus for receiving and protecting a mail that can be removably coupled to various structures and avoids the drawbacks of the prior art.

It is one object of the present invention to provide an apparatus for receiving and protecting a mail. The apparatus comprises a receptacle having a bottom and sidewalls. The bottom and sidewalls define an interior for the receptacle. At one of the sidewalls, a cover is provided, which is operated to form a closed structure with the receptacle. The apparatus further comprises a clamp provided at one of the sidewalls to removably couple the receptacle to a structure. At the interior of the receptacle, a mail is received and the cover is closed to protect the mail.

It is another object of the present invention to provide a connecting means such as a Velcro at the cover to couple the cover to the sidewall.

It is another object of the present invention to removably couple the apparatus to various structures. In order to couple the apparatus to various structures, the apparatus is provided with a clamp having a magnet.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an apparatus for receiving and protecting a mail. The apparatus comprises a receptacle having a bottom and sidewalls. The bottom and sidewalls define an interior for the receptacle. At one of the sidewalls, a cover is provided, which is operated to form a closed structure with the receptacle. The apparatus comprises a clamp provided at one of the sidewalls to removably couple the receptacle to a structure. At the interior of the receptacle, a mail is received and the cover is closed to protect the mail.

Various features and embodiments of an apparatus for receiving and protecting a mail are explained in conjunction with the description of FIGS. 1-4.

Figure 1A:
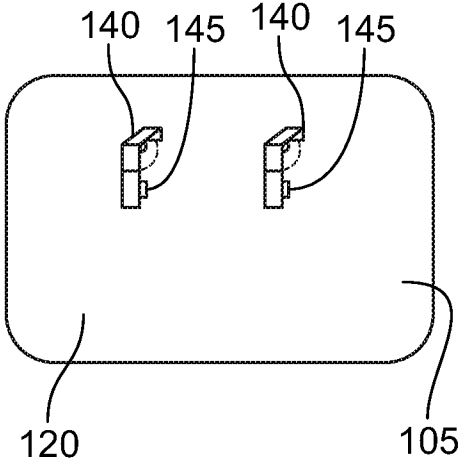
FIG. 1A illustrates a rear view of the apparatus 100, in accordance with one embodiment of the present disclosure.
Figure 1:
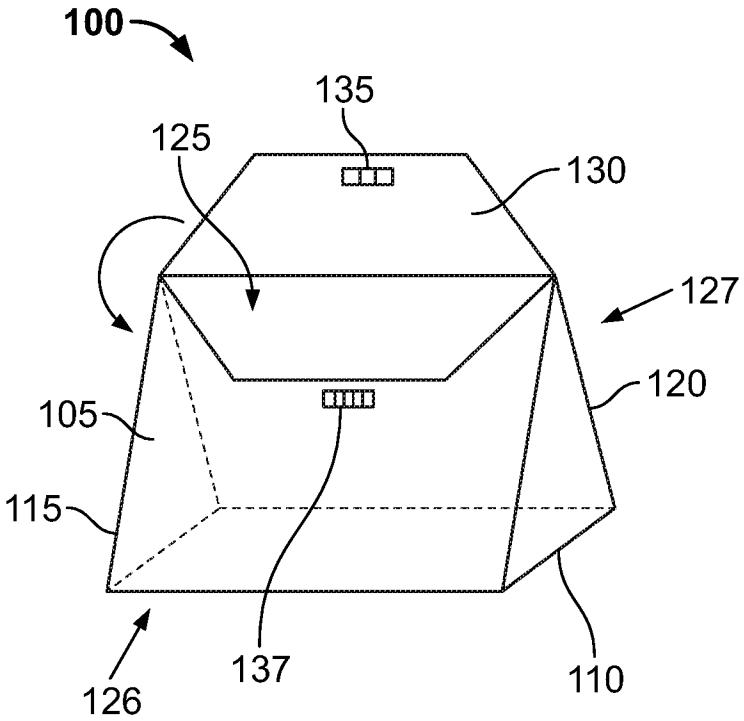
FIG. 1 illustrates a schematic diagram of an apparatus 100 for receiving mails, newspaper and other similar products in an open position, in accordance with one embodiment of the present disclosure.

Referring to FIG. 1, an apparatus 100 for receiving mails, newspaper and other similar products is shown, in accordance with one embodiment of the present disclosure. The apparatus 100 comprises a receptacle or a container 105. The receptacle 105 may be made up of a plastic, a metal or any other suitable material. The receptacle 105 comprises a bottom 110, a front wall 115 and a rear wall 120. The bottom 110, the front wall 115 and the rear wall 120 define an interior 125. It should be understood that the bottom 110, the front wall 115 and the rear wall 120 form a triangular shape or an envelope shape. In one example, the front wall 115 is provided with a cut portion or tapered to form the interior 125 or opening. The apparatus 100 comprises a front end 126 and a rear end 127. It should be understood that the front wall 115 is placed facing the front end 126 and the rear wall 120 is placed facing the rear end 127.

In one example, the receptacle 105 comprises a cover 130 provided at the rear wall 120. In one example, the cover 130 is provided as an integral part of the receptacle 105. As can be seen, the cover 130 may be provided with a first connecting means 135. In one example, the first connecting means 135 may include, but not limited to, a Velcro, an adhesive tape, and so on. Further, the front wall 110 may be provided with a second connecting means 137. In one example, the second connecting means 137 may include, but not limited to, a Velcro, an adhesive tape, and so on.

Now referring to FIG. 1A, a rear view of the apparatus 100 is shown, in accordance with one embodiment of the present disclosure. Specifically, FIG. 1A shows the rear wall 120 of the receptacle 105. In one implementation, the rear wall 120 is provided with one or more clamps 140. The clamps 140 may be made up of a metal or any other suitable material. Each of the clamps 140 comprises a magnet 145. The clamps 140 are used to couple the apparatus 100 to various structures. For example, the clamps 140 are used to couple the apparatus 100 to a wall (not shown) of a building. In another example, the clamps 140 are used to couple the apparatus 100 to a gate (not shown) of the building. When the apparatus 100 is coupled to a metal e.g., to the gate, the magnet 145 helps to grip the apparatus 100 to the gate.

After coupling the apparatus 100 to the wall or the gate, a user may use the apparatus 100 to store or accommodate mails, newspapers or other similar products. In order to place a mail in the receptacle 105, the user may swing open the cover 130 as shown in FIG. 1. After opening the cover 130, the user may place the mail in the interior 125 of the receptacle 105. Subsequently, the user may close the cover 130 such that the first connecting means 135 comes in contact with the second connecting means 137 and helps to hold the cover 130 to the front wall 115.

Figure 2:
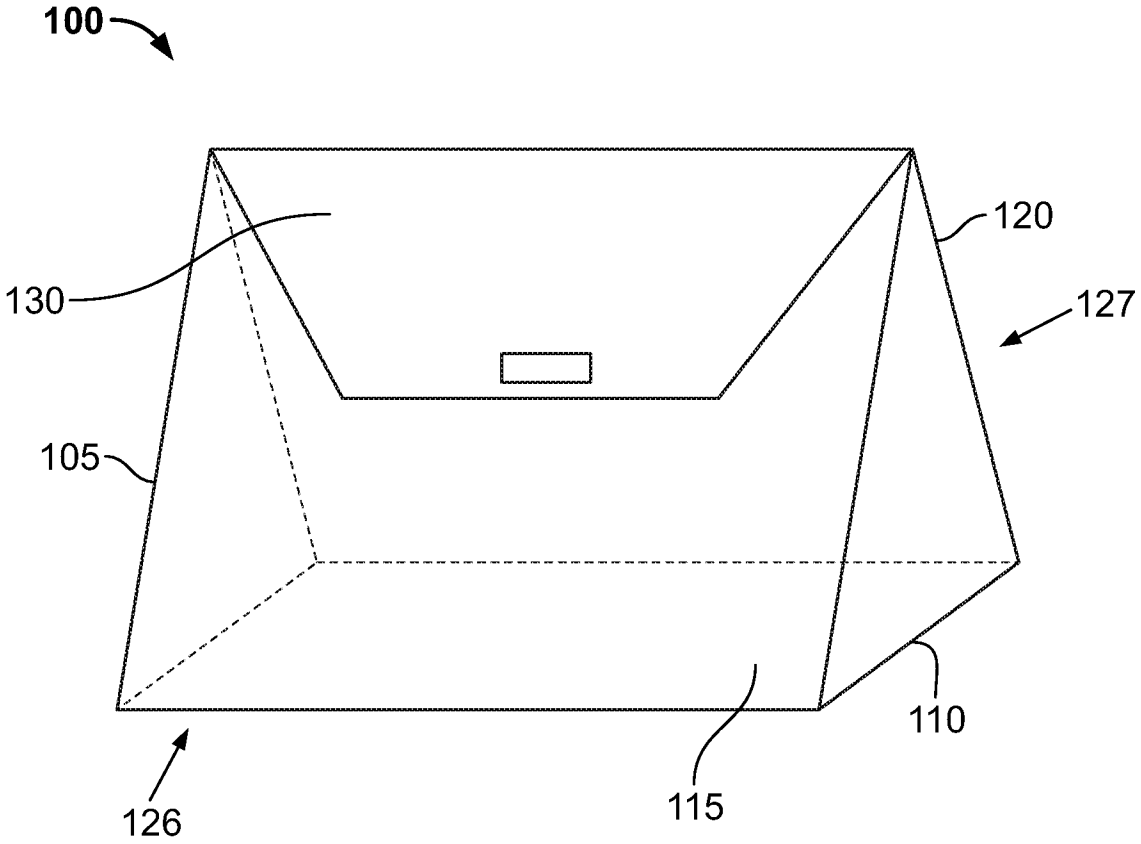
FIG. 2 illustrates the apparatus 100 in a closed position, in accordance with another embodiment of the present disclosure.

Referring to FIG. 2, the apparatus 100 in closed position is shown, in accordance with one embodiment of the present disclosure. Specifically, the cover 130 in closed position forming a closed structure with the receptacle 105 is shown. In other words, when the plate 130 is closed, the receptacle 105 and the cover 130 forms a closed structure. In order to access the mail placed in the receptacle 105, the user may open the cover 130 by pulling the cover 130. After opening, the user may pick up the mail from the interior 125 of the receptacle 105.

Figure 3:
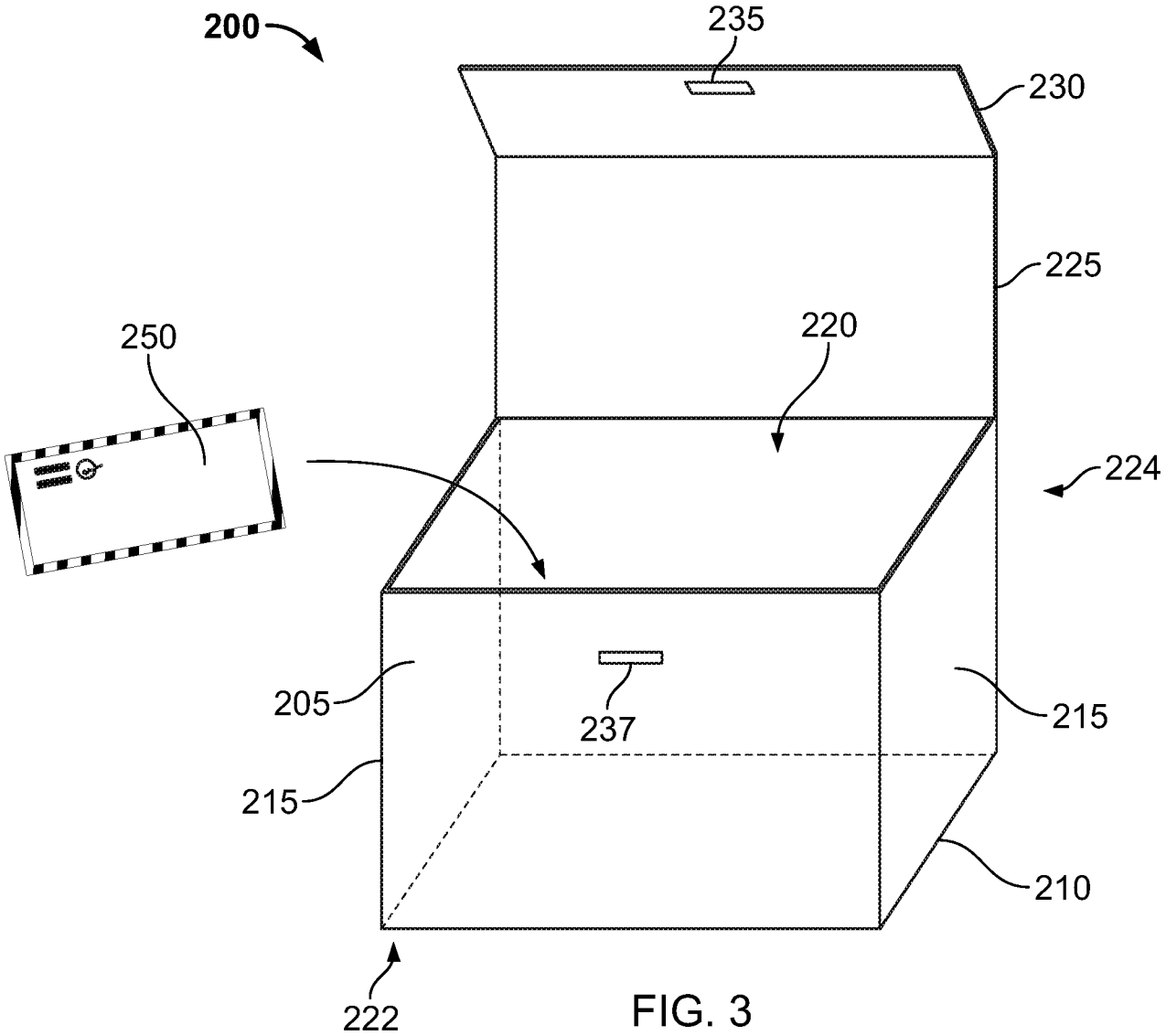
FIG. 3 illustrates a schematic diagram of an apparatus 200 for receiving mails, newspaper and other similar products in an open position, in accordance with another embodiment of the present disclosure.

Now referring to FIG. 3, an apparatus 200 for storing mails or newspapers or similar items is shown, in accordance with another embodiment of the present disclosure. The apparatus 200 comprises a receptacle 205 provided in a square or rectangular or any other shape. The receptacle 205 may be made up of plastic, metal or other suitable material. The receptacle 205 comprises a bottom 210 and sidewalls 215. The bottom 210 and the sidewalls 215 define an interior 220 and an open top.

The apparatus 200 comprises a front end 222 and a rear end 224. In one example, the receptacle 205 comprises a first plate 225 and a second plate 230. As can be seen in FIG. 3, the first plate 225 is coupled to the sidewall 215 provided at the rear end 224 of the apparatus 200. Further, the second plate 230 is coupled to the first plate 225. In one example, the second plate 230 is provided with a first connecting means 235. Further, the sidewall 215 at the front end 222 is provided with a second connecting means 237.

At the rear end 224 of the receptacle 205, the sidewall 215 is provided with one or more clamps (not shown) as explained above. Further, each of the one or more clamps may comprise a magnet (not shown). The clamps may be used to couple the receptacle 205 to a wall or any other structure in the house as explained above.

Figure 4:
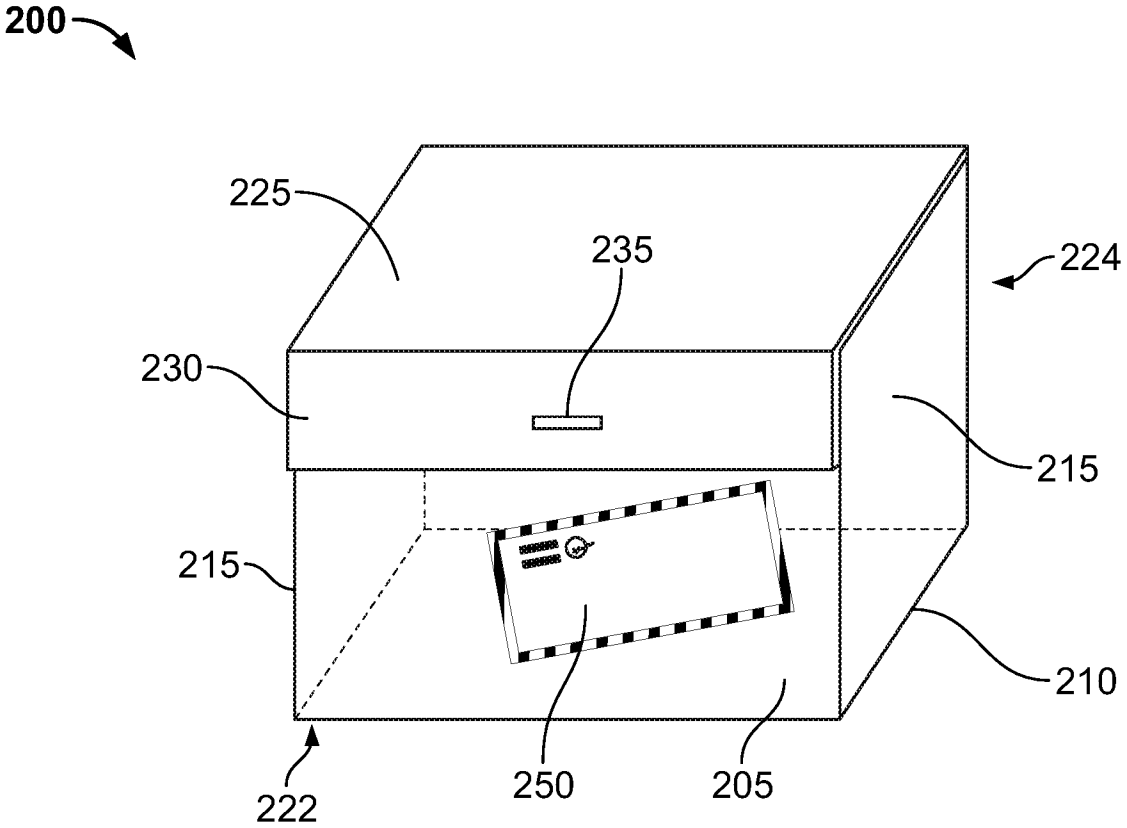
FIG. 4 illustrates the apparatus 200 having a mail 250, in accordance with one embodiment of the present disclosure.

The apparatus 200 may be used to receive a mail 250. In order to place the mail 250 in the interior 220 of the receptacle 205, the user may swing open the first plate 225 and the second plate 230. Subsequently, the user may place the mail 250 in the receptacle 205. After placing the mail 250 in the receptacle 205, the user may close the first plate 225 and the second plate 230 such that the second plate 230 comes in contact with the sidewall 215 at the front end 222, as shown in FIG. 4. It should be understood that when the first plate 225 and the second plate 230 are closed, the first connecting means 235 comes in contact with the second connecting means 237 to couple the second plate 230 to the sidewall 215 at the front end 222.

In order to access the mail 250, the user may open the first plate 225 and lift the first plate 225 and the second plate 230. After lifting, the user may access the mail 250 and close the first plate 225 and the second plate 230.

It is evident from the above disclosure that the apparatus can be used anywhere in the building i.e., indoors or outdoors. In order to couple the apparatus, a user may couple the apparatus to a structure with the help of the clamp. Further, the user place and remove the mails easily by operating the cover. The cover may be secured to the sidewalls of the apparatus with the help of a Velcro or adhesive tape or any other known mechanism.

In order to change the location of the apparatus e.g., wall mount to a post or to a gate, the user may remove the apparatus by detaching the clamp and couple the apparatus to the post with the help of the clamps provided at the rear end.

As specified above, the receptacle i.e., walls, covers are made up of plastic or metal, which are waterproof. As such, the mails or newspapers placed inside the receptacle do not come in contact with water during rainy season or not exposed to extreme weather.

Further, the apparatus may be placed at the wall of the house or to a gate of the house. As such, the user of the house may leave the mail for a mail carrier or mailman or postman to pickup. Similarly, the postman may leave the mail for the user or occupant of the house.

The apparatus may be provided in a suitable size as may be desired by the user of the house. Further, the apparatus may be made using suitable material to protect the mails and stamps put on the mails from rain, snow, wind and other extreme weather conditions. It should be obvious that the apparatus may be placed at houses, apartments, office buildings and public places to deliver or collect mails.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for receiving and protecting mail, the apparatus comprising:

a receptacle comprising a bottom and sidewalls, wherein the bottom and sidewalls define an interior for the receptacle, wherein said bottom is a rectangular base having perimeter sides, wherein said sidewalls include triangular sidewalls located at two opposite perimeter sides of said rectangular base, wherein said sidewalls further include rectangular sidewalls located at the other two opposite perimeter sides of said rectangular base, wherein said receptacle further includes a top opening being trapezoidal in shape, wherein said receptacle further in includes a back end having clamps, wherein said clamps lie entirely within a perimeter of said back end of said receptacle, wherein said clamps include an attaching sidewall being coupled to said back end of said receptacle and further includes a hook portion, wherein said hook portion extends downwardly beyond said attaching sidewall a predetermined amount, wherein said clamps further include a magnetic member located near a distal end of said hook portion, wherein said clamps are configured to removably couple said receptacle to a structure, and a cover coupled to one of said rectangular sidewalls, wherein the cover is operated to form a closed structure with the receptacle, wherein said cover is trapezoidal in shape, wherein said cover extends a predetermined amount over said top opening of said receptacle, wherein the mail is received at the interior of the receptacle and the cover is closed to protect the mail.

2. The apparatus of claim 1, wherein the cover comprises a connecting means used to couple the cover to the one rectangular sidewall to form the closed structure with the receptacle.

3. The apparatus of claim 1, wherein said cover further includes a first connecting member rectangular in shape located on a bottom end of said cover, wherein said first connecting member is a hook fastening member.

4. The apparatus of claim 3 wherein a front end of said receptacle further includes a second connecting member near a top edge of said opening, wherein said second connecting member is a loop fastening member, wherein said loop fastening member receives said hook fastening member to create a hook and loop fastener connection.

5. The apparatus of claim 1 wherein said cover extends over a front end of said receptacle a predetermined amount.

6. An apparatus for receiving mail, the apparatus comprising:

a receptacle comprising a bottom and sidewalls wherein the bottom and sidewalls define an interior for the receptacle, wherein said receptacle is cubic rectangular in shape and includes a rectangular top opening, wherein said receptacle further in includes a back end having clamps, wherein said clamps lie entirely within a perimeter of said back end of said receptacle, wherein said clamps have an "L" shape and are mounted parallel to each other on said back end of said receptacle, wherein said clamps include an attaching sidewall being coupled to said back end of said receptacle and further includes a hook portion, wherein said hook portion extends downwardly beyond said attaching sidewall a predetermined amount, wherein said hook portion is an "L" shaped hook having a vertical component and a horizontal component, wherein the length of said vertical component is greater than said horizontal component, wherein said clamps further include a magnetic member located near a distal end of said hook portion, wherein said clamps a configured to removably couple said receptacle to a structure; and a cover coupled to one of the sidewalls, wherein the cover is operated to form a closed structure with the receptacle, wherein said cover is rectangular in shape and further includes a flap located at an outer edge of said cover, wherein said cover corporates with the shape of said top opening, wherein sidewalls of said cover remain flush with said sidewalls of said receptacle, wherein said flap extends over a front end of said receptacle a predetermined amount, wherein the bottom end of said flap includes a first connecting member being a hook fastening member, wherein said front end of said receptacle further includes a second connecting member being a loop fastening member, wherein said hook fastening member couples with said loop fastening member to create a secure hook and loop fastening connection, wherein mail is received at the interior of the flexible plastic envelope and the front flap is closed to protect the mail.

* * * * *